United States Patent [19]

Aotsuka et al.

[11] Patent Number: 4,755,454

[45] Date of Patent: Jul. 5, 1988

[54] ELEMENT HAVING A SILVER HALIDE PHOTOGRAPHIC LAYER ON A POLYOLEFIN COATED PAPER BASE

[75] Inventors: Yasuo Aotsuka; Soichiro Yamamoto, both of Kanagawa, Japan

[73] Assignee: Fuji Photo Film Co., Ltd., Kanagawa, Japan

[21] Appl. No.: 941,503

[22] Filed: Dec. 12, 1986

Related U.S. Application Data

[63] Continuation of Ser. No. 778,044, Sep. 20, 1985, abandoned, which is a continuation-in-part of Ser. No. 593,757, Mar. 27, 1984, abandoned.

[30] Foreign Application Priority Data

Mar. 29, 1983 [JP] Japan ..... 59-54741

[51] Int. Cl.[4] ..... G03C 1/86

[52] U.S. Cl. ..... 430/538; 430/531; 430/536; 430/539

[58] Field of Search ..... 430/538, 539, 531, 536

[56] References Cited

U.S. PATENT DOCUMENTS

| | | | |
|---|---|---|---|
| 3,973,963 | 8/1976 | Venor et al. | 430/538 |
| 4,389,455 | 6/1983 | Asao | 430/538 |
| 4,407,896 | 10/1983 | Kubbota et al. | 430/538 |
| 4,407,939 | 10/1983 | Naoi et al. | 430/538 |

FOREIGN PATENT DOCUMENTS 55-139642 10/1980 Japan .

*Primary Examiner*—Jack P. Brammer

*Attorney, Agent, or Firm*—Sughrue, Mion, Zinn, Macpeak, and Seas

[57] ABSTRACT

A photographic paper material comprising:

(1) a support comprising a paper substrate with a synthetic resin film provided on both sides thereof;

(2) a hydrophilic colloid layer containing a white pigment on one side of the support (1); and (3) a light-sensitive silver halide emulsion layer on the hydrophilic colloid layer (2), wherein the white pigment content of the hydrophilic colloid layer (2) is at least about 68% by weight.

12 Claims, No Drawings

ELEMENT HAVING A SILVER HALIDE PHOTOGRAPHIC LAYER ON A POLYOLEFIN COATED PAPER BASE

This is a continuation of application Ser. No. 778,044, filed Sept. 20, 1985, now abandoned, which is a continuation-in-part of Ser. No. 593,757, filed Mar. 27, 1984, now abandoned.

FIELD OF THE INVENTION

The present invention relates to a photographic paper material utilizing a synthetic resin film-coated paper substrate as a support, which has increased sharpness and sensitivity.

The present invention further relates to a photographic paper material with a synthetic resin film-coated paper substrate as a support, which is improved so that even if finished photographic images are observed under varied conditions, the image contrast is kept constant.

BACKGROUND OF THE INVENTION

In view of the recent tendency to speed up the photographic processing of photographic light-sensitive materials, a so-called water-resistant photographic paper utilizing a polyolefin-coated paper as a support has been developed and put to practical use. These water-resistant photographic papers using as a support a paper substrate, both surfaces of which are coated with a polyolefin, a hydrophobic resin, have advantages in that fatigue of the developer can be reduced and the time required for rinsing and drying after development can be greatly shortened, since the support absorbs the developer to a lesser extent. Furthermore, these supports have superior dimensional stability.

However, when compared with photographic images formed in conventional photographic paper materials using a baryta-coated paper as a support, photographic images formed in photographic paper materials utilizing a polyolefin-coated paper as a support have the disadvantage that the sharpness is poor.

The cause of the foregoing defect is believed to be due to the light-barrier effect of the white pigment incorporated in a polyolefin layer of the support, this polyolefin layer being in contact with a light-sensitive silver halide emulsion layer, is obtained only insufficiently since the amount and weight% of the white pigment are small. Therefore, light is scattered or diffused in the polyolefin layer. However, it is very difficult to increase the weight% of the white pigment in the polyolefin layer to about 68% or more.

Furthermore, when photographic images formed in the conventional photographic paper materials using baryta-coated paper as a support are compared, the photographic images formed in the photographic paper materials utilizing a polyolefin-coated paper as a support have the disadvantage that the image density contrast looks as if it were deteriorated depending on observation conditions. For example, when photographic images on polyolefin-coated paper are looked at, a clear distinction can be observed between the case where they are placed on a white plate and the case where they are placed on a black plate. That is, when the photographic images are placed on the black plate, the entire image looks as if it were blackened, and this is more noticeable in areas with a white background. As a result, it looks as if the image contrast drops and the degree of whiteness of the white background is deteriorated. On the other hand, with photographic images on baryta-coated paper, the above-described phenomenon does not occur or occurs only to a limited extent. Similarly, when photographic images on polyolefin-coated paper are observed not on plates as described above but while they are held in the air, their image contrast looks as if it was reduced, in comparison with photographic images on baryta-coated paper.

The cause of the phenomenon is believed to be due to the light-barrier effect of white pigment incorporated in the polyolefin layer of the support, this polyolefin layer being in contact with a light-sensitive silver halide emulsion layer. This effect insufficiently obtained since the amount and weight% of the white pigment are small. Therefore, part of light is allowed to pass through the support.

In order to improve the reduction in sharpness of the above-described defects, Japanese Patent Application (OPI) No. 54225/82 (the term "OPI" as used herein means a "published unexamined Japanese patent application) discloses a method in which a hydrophilic colloid layer containing a white pigment and a dye capable of being decolored during the process of development is sandwiched between a polyolefin-coated paper substrate and a light-sensitive silver halide emulsion layer. In one of the examples described in the specification of Japanese Patent Application (OPI) No. 64235/82, a hydrophilic colloid layer is provided which contains a white pigment in an amount of about 48% expressed in terms of weight%. Even at these low contents, the sharpness is improved to a certain extent, as described in this patent specification, if the white pigment is used in combination with the dye. That is, if the white pigment content is small, the mean distance between the pigment grains is increased and the degree of permeation of light through the white pigment-containing layer, i.e., the degree of diffusion of light, is increased due to the synergistic effects because of the effect that the amount of light capable of passing in a straight line through spaces between the grains and the effect that the distance for which light can advance in a straight line is greatly increased. On the other hand, when the white pigment content is high, in particular, as the theoretical closest packing rate (in the case of completely spherical grains, about 90%, expressed in terms of weight%) is reached, the degree of diffusion of light in the white pigment-containing layer is decreased abruptly and the sharpness of the photographic images is greatly increased. In practice, however, the white pigment grains are not spherical and grain sizes are not indential. Moreover, the white pigment grains are not always uniformly dispersed in the hydrophilic colloid. It has been found experimentally that when the white pigment content of the white pigment-containing layer exceeds about 68% by weight, the sharpness is greatly increased, although this does not completely correspond to the theoretical closest packing rate. It has further been found that the photographic sensitivity of the light-sensitive silver halide emulsion layer is increased although only to a small extent.

The reason for this is believed to be due to the degree of permeation of light into the white pigment-containing layer being reduced, i.e., the amount of light passing through to the support is reduced, the proportion of light returning to the light-sensitive silver halide emulsion layer is increased.

SUMMARY OF THE INVENTION

It has been found according to the present invention that in photographic paper materials comprising a support, both sides of which are coated with a synthetic resin film, a hydrophilic colloid layer containing a white pigment as provided on one of the synthetic resin film layers on the support, and a light-sensitive silver halide emulsion layer on the hydrophilic colloid layer, the sharpness can be greatly improved by increasing the white pigment content of the hydrophilic colloid layer to at least about 68% by weight.

The present invention thus provides a photographic paper material comprising:

(1) a support comprising a paper substrate, with a synthetic resin film provided on both sides thereof;

(2) a hydrophilic colloid layer containing a white pigment as provided on one side of the support (1); and (3) a light-sensitive silver halide emulsion layer on the hydrophilic colloid layer (2), wherein the white pigment content of the hydrophilic colloid layer (2) is at least about 68% by weight.

DETAILED DESCRIPTION OF THE INVENTION

The object of the present invention is attained as long as the white pigment content of the hydrophilic colloid layer is within the range from about 68 to about 93% by weight based on the volume of the hydrophilic colloid layer. In order for the effect to be exhibited sufficiently and to produce a sufficient film strength for practical use, the white pigment content is preferably between 76 to 88% by weight.

It is necessary for the amount of the white pigment being coated to be at least about 2 g/m$^2$ on the support. In order to permit the effect to be exhibited sufficiently, the coated amount is preferably at least 4 g/m$^2$.

The thickness of the hydrophilic colloid layer containing the white pigment is determined by the above-described content and amount; but the thickness is usually from about 1 to about 10$\mu$ and preferably from 2 to 5$\mu$.

The hydrophilic colloid layer preferably is in contact with the light-sensitive silver halide emulsion layer. In some cases, another hydrophilic colloid layer (called an intermediate layer) may be interposed between the hydrophilic colloid layer and the light-sensitive silver halide emulsion layer. In this case, however, the thickness of the intermediate layer should be about 5 $\mu$m or less, with a thickness of 2 $\mu$m or less being preferred. If the thickness of this other hydrophilic colloid layer is in excess of about 5 $\mu$m, the effect of the present invention of increase as sharpness is seriously decreased.

In the present invention, when the intermediate layer is interposed between the hydrophilic colloid layer and the silver halide emulsion layer, irradiation-preventing dyes or antifoggants may be present in the intermediate layer.

Suitable white pigments which cause used in the present invention include titanium dioxide, barium sulfate, lithopone, alumina white, calcium carbonate, silica white, antimony trioxide, titanium phosphate, zinc oxide, lead white, and gypsum. Of these compounds, titanium dioxide is especially effective. Titanium dioxide may be either of the rutile type or of the anatase type, or it may be produced by any of the sulfate method and the chloride method. With regard to the grain size of the white pigment, it is effective for the mean grain size used in the hydrophilic colloid layer to be within the range of from about 0.1 to about 1.0$\mu$. Preferably the mean grain size is between 0.2 and 0.3$\mu$.

Any hydrophilic colloid-forming materials which are commonly used in photographic materials can be used as a binder for use in the hydrophilic colloid layer of the present invention. Examples are natural polymeric compounds such as gelatin and its derivatives, and synthetic polymers such as polyvinyl alcohol and polyvinyl pyrrolidone. Gelatin is particularly preferred.

In addition to the binder and white pigment, additives conventionally present in the emulsion layers of th photographic materials can be present in the hydrophilic colloid layer of the present invention. For example, surfactants as coating aids, hardeners, dyes, and antifoggants can be added.

In the present invention, the white pigment may be present in the synthetic resin film covering the paper substrate as well as in the hydrophilic colloid layer. In this case, it is especially preferred for the white pigment to be present in the synthetic resin film layer on which the light-sensitive silver halide emulsion layer is to be provided.

The synthetic resin film for use in the photographic paper material of the present invention can be made of polyolefin, polyester, and so forth. Preferably the film is made of polyolefin. Polyethylene is an especially preferred synthetic resin.

Various chemical sensitizers can be used in the silver halide emulsions for use in the preparation of the photographic paper material of the present invention. For chemical sensitization, a sulfur sensitization method using sulfur-containing compounds capable of reacting with active gelatin and silver (e.g., thiosulfate salts, thioureas, mercapto compounds, and rhodamines), a reduction sensitizing method using reducing substances (e.g., stannous salts, amines, hydrazine derivatives, formamizine derivatives, formamizinesulfinic acid, and silane compounds), a noble metal sensitization method using noble metal compounds (e.g., gold complex salts and complex salts of Group VIII metals of the Periodic Table, such as Pt, Ir and Pd), and so forth can be used alone or in combination with each other.

The sulfur sensitization method which can be used is described in, for example, U.S. Pat. Nos. 1,574,944, 2,410,689, 2,278,947, 2,728,668, and 3,656,955. The reduction sensitization method is described in, for example, U.S. Pat. Nos. 2,983,609, 2,419,974, and 4,054,458. The noble metal sensitization method which can be used is described in, for example, U.S. Pat. Nos. 2,399,083, 2,448,060, and British Pat. No. 618,061.

Various compounds can be incorporated into the photographic emulsions as used herein for the purpose of preventing fog during the production, storage or photographic processing of the light-sensitive material, or for the purpose of stabilizing the photographic performance. That is, many compounds known as antifoggants or stabilizers, such as azoles (e.g., benzothiazolium salts, nitroindazoles, triazoles, benzotriazoles, and benzimidazoles, particularly nitro or halogen-substituted benzimidazoles); heterocyclic mercapto compounds (e.g., mercaptothiazoles, mercaptobenzothiazoles, mercaptobenzimidazoles, mercaptothidiazoles, mercaptotetrazoles, particularly 1-phenyl-5-mercaptotetrazole, and mercaptopyrimidines); the foregoing heterocyclic mercapto compounds containing a water-soluble group (e.g., a carboxyl group and a sulfone group); thioketone compounds (e.g., oxazainethione;

azaindenes (e.i. tetraazaindenes, particularly 4-hydroxy-substituted (1,3,3a,7)tetraazaindenes); benzenethiosulfonic acids; and benzenesulfinic acids, can be employed.

The photographic emulsion layers and other hydrophilic colloids layers of the light-sensitive material of the present invention may contain various surfactants for various purposes; for example, as coating aids, or for the purpose of preventing electrostatic charging, improving sliding properties, accelerating emulsification and dispersion, or for improving photographic properties (e.g., acceleration of development, hardening, and sensitization).

Surfactants which can be used include nonionic surfactants such as saponin (steroid), alkylene oxide derivatives (e.g., polyethylene glycol, polyethylene glycol/-polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, and polyethylene oxide adducts of silicone), glycidol derivatives (e.g., alkenylsuccinic acid polyglyceride and alkylphenol polyglyceride), fatty acid esters of polyhydric alcohols, and alkyl esters of saccharides; anionic surfactants containing an acidic group (e.g, a carboxyl group, a sulfo group, a phospho group, a sulfate group, and a phosphate group), such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurins, sulfosuccinic acid esters, sulfoalkyl polyoxyethylene alkyl phenyl ethers, and polyoxy ethylene alkyl phosphoric acid esters; amphoteric surfactants such as amino acids, aminoalkylsulfonic acids, aminoalkylsulfuric acid or phosphoric acid esters, alkylbetaines, and amine oxides; and cationic surfactants such as alkylamine salts, aliphatic or aromatic quaternary ammonium salts, heterocyclic quaternary ammonium salts (e.g., pyridinium and imidazolium salts), and aliphatic or heterocyclic phosphonium or sulfonium salts.

The light-sensitive material of the present invention may contain inorganic or organic hardeners in the photographic emulsion layers or other hydrophilic colloid layers thereof. For example, chromium salts (e.g., chromium alum and chromium acetate), aldehydes (e.g., formaldehyde, glyoxal, glutaraldehyde, etc.), N-methylol compounds (dimethylolurea and methyloldimethylhydantoin), dioxane derivatives (e.g., 2,3-dihydroxydioxane), active vinyl compounds (e.g., 1,3,5-triacryloyl-hexahydro-s-triazine, and 1,3-vinylsulfonyl-2-propanol), active halo compounds (e.g., 2,4-dichloro-6-hydroxyl-s-triazine), and mucohalic acids (e.g., mucochloric acid and mucophenoxychloric acid) can be used alone or in combination with each other.

The photographic emulsion layers of the light-sensitive material of the present invention may contain colorforming couplers, i.e., compounds capable of forming color through oxidative coupling with aromatic primary amine developers (e.g., phenylenediamine derivatives and aminophenol derivatives) in the color developing process. For example, a 5-pyrazolone coupler, a pyrazolobenzimidazole coupler, a cyanoacetylcumarone coupler, and an open chain acylacetonitrile coupler can be used as magenta couplers; an acylacetamide coupler (e.g., benzoylanilides and pivaroylacetoanilides) can be used as yellow couplers; and a naphthol coupler and a phenol coupler can be used as cyan couplers. These couplers are preferably non-diffusing couplers containing a hydrophobic ballast group. The couplers may be either four equivalent or two equivalent relative to silver ion. In addition, colored couplers having the effect of color correction or so-called development inhibitor releasing (DIR) couplers releasing a development inhibitor as development progresses can be used. In addition to the DIR couplers, colorless DIR coupling compounds which provide a colorless coupling reaction product and release a development inhibitor may be used.

The light-sensitive material of the present invention may contain ultraviolet absorbers in the hydrophilic colloid layers thereof. Ultraviolet absorbers which can be used include benzotriazole compounds substituted with an aryl group, 4-thiazolidone compounds, benzophenone compounds, cinnamic acid ester compounds, butadiene compounds, and benzooxazole compounds. In addition, ultraviolet absorbing polymers can be used. These ultraviolet absorbers may be fixed in the hydrophilic colloid layers.

The photographic emulsions as used herein may be spectrally sensitized using methine dyes and so forth. These sensitizing dyes may be used alone or in combination with each other. A combination of sensitizing dyes is often used for the purpose of supersensitization. Dyes which do not have a spectral sensitization action by themselves or substances not materially absorbing visible light but exhibiting strong color sensitization may be present in the emulsions in combination with the sensitizing dyes.

Useful sensitizing dyes, dye combinations exhibiting supersensitization, and substances showing supersensitization are described in *Research Disclosure,* Vol. 176, No. 17643 (published December 1978), page 23, Chapter IV, Clause J.

Known anti-fading agents as described hereinafter can be used in combination in the practice of the present invention. Color image stabilizers as used herein can be used alone or in combination with each other. Known anti-fading agents which can be used include hydroquinone derivatives, galaic acid derivatives, p-alkoxyphenols, p-oxyphenol derivatives, and bisphenols.

Typical examples of the hydroquinone derivatives are described in U.S. Pat. Nos. 2,360,290, 2,418,613, 2,675,314, 2,701,197, 2,704,713, 2,728,659, 2,732,300, 2,735,765, 2,710,801, 2,816,028, and British Pat. No. 1,363,921. Typical examples of the gallic acid derivatives are described in U.S. Pat. Nos. 3,457,079 and 3,069,262. Typical examples of the p-alkoxyphenols are described in U.S. Pat. Nos. 2,735,765, 3,698,909, Japanese Patent Publication Nos. 20977/74 and 6623/77. Typical examples of the p-oxyphenol derivatives are described in U.S. Pat. Nos. 3,432,300, 3,573,050, 3,574,627, 3,764,337, Japanese Patent Application (OPI) Nos. 35633/77, 147434/77 and 152225/77. Typical examples of the bisphenols are described in U.S. Pat. No. 3,700,455.

The present invention is applicable to a multi-layer polychromatic photographic material comprising a support and at least two layers with different spectral sensitivities. These multi-layer polychromatic photographic materials usually comprise a support and at least one red-sensitive silver halide emulsion layer, at least one green-sensitive silver halide emulsion layer, and at least one blue-sensitive silver halide emulsion layer. The order in which these layers are present on the support is not critical and can be determined appropriately. Usually a cyan forming coupler is present in the red-sensitive emulsion layer; a magentaforming coupler, in the green-sensitive emulsion layer; and a yellow-forming coupler, in the blue-sensitive emulsion layer. In some cases, however, other combinations can be employed.

Known techniques and known processing solutions as described in *Research Disclosure,* No. 176, pages 28–30 (RD-17643) can be used in photographic processing of the light-sensitive material of the present invention. This photographic processing may be either a black and white photographic processing to form a silver image or a color photographic processing to form a dye image. The processing temperature is usually chosen within the range of from about 18° to about 50° C. Lower temperatures than about 18° C. or higher temperatures than about 50° C. may be employed.

Color developers generally comprise alkaline aqueous solutions containing color developing agents. Known primary aromatic amine developers, such as phenylenediamines (e.g., 4-amino-N,N-dimethylaniline, 3-methyl-4-amino-N,N-dimethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, and 4-amino-3-methyl-N-ethyl-N-β-methoxyethylaniline) can be used as the color developing agents.

In addition, the compounds described in L. F. A. Mason, *Photographic Processing Chemistry,* the Focal Press, (1966), pages 226–229, U.S. Pat. Nos. 2,193,015, 2,592,364, and Japanese Patent Application (OPI) No. 64933/73 can be used.

After color development, the photographic emulsion layers are usually bleached. This bleaching may be performed simultaneously with fixing or the bleaching and fixing may be performed separately. Compounds of polyvalent metals, such as iron (III), cobalt (III), chromium (VI), and copper (II), peracids, quinones, nitroso compounds, and so forth can be used as bleaching agents.

For example, ferricyanides, dichromates, organic complex salts of iron (III) or cobalt (III), and complex salts of organic acids such as aminopolycarboxylic acids (e.g., ethylenediaminetetraacetic acid, nitrilotriacetic acid, and 1,3-diamino-2-propanoltetraacetic acid), citric acid, tartaric acid, and malic acid; persulfates salts, and permanganates; and nitrosophenol can be used. Of these compounds, potassium ferricyanide, iron (III) sodium ethylenediaminetetraacetate, and iron (III) ammonium ethylenediaminetetraacetate are especially useful. Ethylenediaminetetraacetic acid iron (III) complex salts are useful in both an independent bleaching solution or a monobath bleachfixing solution.

As a special developing technique a method may be employed in which a developing agent or auxiliary developing agent is incorporated in a light-sensitive material, e.g., an emulsion layer thereof, and the light-sensitive material is developed by treatment in an alkaline aqueous solution or developer.

The present invention as described in greater detail with reference to the following examples. Unless otherwise indicated, all parts, percents, ratios and the like are by weight.

EXAMPLE 1

Polyethylene was laminated in a thickness of 40μ on both sides of a paper substrate having a basis weight of 180 g/m$^2$ to prepare a support. A hydrophilic colloid layer and a silver halide emulsion layer having the formulations as described below were coated on the above-prepared support in the listed sequence to prepare a photographic light-sensitive material (Sample A).

First Layer (White Pigment-Containing Layer)

A mixture of 350 g of rutile type titanium white pigment (Titan White R780, manufactured by Ishihara Sangyo Co., Ltd.) having a mean grain size of 0.23μ and 10 ml of a 5% aqueous solution of sodium dodecylbenzenesulfonate as a dispersing agent was added to 1 kg of 5% gelatin and dispersed therein using supersonic waves. Then, 20 ml of a 2% aqueous solution of sodium 2,4-dichloro-6-oxy-s-triazine (hereinafter abbreviated to "DCT") was added, and the resulting mixture was coated on the support in a dry film thickness of 3 μm.

Second Layer (Gelatin Intermediate Layer)

A mixture of 10 ml of a 5% aqueous solution of sodium dodecylbenzenesulfonate and 20 ml of a 2% aqueous solution of DCT was added to 1 kg of 5% gelatin, and the resulting mixture was coated in a dry film thickness of 2μ.

In addition, a third layer to an eighth layer having the formulations shown in Table 1 below were provided.

TABLE 1

| | |
|---|---|
| Eighth Layer (Protective layer) | |
| Gelatin | 1000 mg/m$^2$ |
| Seventh Layer (Red-sensitive layer) | |
| Silver Chlorobromide Emulsion (Br: 50 mol %) | 300 mg/m$^2$ (calculated as silver) |
| Gelatin | 1000 mg/m$^2$ |
| Cyan Coupler (*1) | 400 mg/m$^2$ |
| Coupler Solvent (*2) | 200 mg/m$^2$ |
| Sixth Layer (Intermediate layer) | |
| Gelatin | 1200 mg/m$^2$ |
| Ultraviolet Absorber (*3) | 1000 mg/m$^2$ |
| Ultraviolet Absorber Solvent (*2) | 250 mg/m$^2$ |
| Fifth Layer (green-sensitive layer) | |
| Silver Chlorobromide Emulsion (Br: 50 mol %) | 200 mg/m$^2$ (calculated as silver) |
| Gelatin | 1000 mg/m$^2$ |
| Magenta Coupler (*4) | 300 mg/m$^2$ |
| Coupler Solvent (*5) | 600 mg/m$^2$ |
| Fourth Layer (Intermediate layer) | |
| Gelatin | 1000 mg/m$^2$ |
| Third Layer (Blue-sensitive layer) | |
| Silver Chlorobromide Emulsion (Br: 80 mol %) | 400 mg/m$^2$ (calculated as silver) |
| Gelatin | 1200 mg/m$^2$ |
| Yellow Coupler (*6) | 300 mg/m$^2$ |
| Coupler Solvent (*7) | 150 mg/m$^2$ |

(*1) Coupler: 2-[α-(2,4-Di-tert-pentylphenoxy)butaneamido-4,6-dichloro-5-methylphenol
(*2) Solvent: Dibutyl phthalate
(*3) Ultraviolet Absorber: 2-(2-Hydroxy-3-sec-butyl-5-tert-butylphenyl)benzotriazole
(*4) Coupler: 1-(2,4,6-Trichlorophenyl)-3-(2-chloro-5-tetradecaneamido)anilino-4-{(2-n-butoxy-5-tert-octyl)phenylthio}-2-pyrazolin-5-one
(*5) Solvent: Tricresyl phosphate
(*6) Coupler: α-Pivaloyl-α-(2,4-dioxo-5,5'-dimethyloxazolidin-3-yl)-2-chloro-5-[α-(2,4-di-tert-pentylphenoxy)butaneamido]acetoanilide
(*7) Solvent: Dioctylbutyl phosphate Samples B, C, D and H were prepared in the same manner as described for the preparation of Sample A except that the amount of the titanium white pigment used in preparing the coating solution for the first layer was changed to 200 g, 110 g, 50 g and 87 g, respectively.

Sample E was prepared in the same manner as described for Sample A except that the amount of the titanium white pigment used was changed to 110 g and the coating solution was coated in a dry film thickness of 1.8 μm.

Sample F was prepared in the same manner as described for Sample A except that the second layer was omitted.

Sample G was prepared in the same manner as described for Sample A except that the first and second layers were omitted.

The amount of the titanium white pigment coated and the volume percent of the titanium white pigment in the first layer (white pigment-containing layer) are shown in Table 2 below.

TABLE 2

| Sample | Amount of Titanium White Pigment Coated (g/m²) | Weight Percent of Titanium White Pigment (%) | Second Layer (Intermediate Layer) |
|---|---|---|---|
| A | 8.89 | 87 | — |
| B | 7.1 | 80 | — |
| C | 5.2 | 68.5 | — |
| D | 3.1 | 50 | — |
| E | 3.1 | 68.5 | — |
| F | 8.8 | 87 | omitted |
| G | 0 | 0 | omitted |
| H | 4.5 | 63 | — |

Each sample was exposed stepwise to blue light, green light and red light, and then developed as follows:

| | Temperature (°C.) | Time (min.) |
|---|---|---|
| Development | 33 | 3.5 |
| Bleach-Fixing | 33 | 1.5 |
| Rinsing | 28–35 | 3 |

| Developer | |
|---|---|
| Benzyl Alcohol | 15 ml |
| Diethylenetriaminetetraacetic Acid | 5 g |
| KBr | 0.4 g |
| $Na_2SO_3$ | 5 g |
| $Na_2CO_3$ | 30 g |
| Hydroxyamine Sulfate | 2 g |
| 4-Amino-3-methyl-N—ethyl-N—β-(methanesulfonamido)ethylaniline.3/2 $H_2SO_4.H_2O$ | 4.5 g |
| Water to make | 1000 ml (pH = 10.1) |

| Bleach-Fixing Solution | |
|---|---|
| Ammonium Thiosulfate (70% by weight aq. solution) | 150 ml |
| $Na_2SO_3$ | 5 g |

-continued

| Bleach-Fixing Solution | |
|---|---|
| Na [Fe(EDTA)] | 40 g |
| EDTA | 4 g |
| Water to make | 1000 ml (pH = 6.8) |

The density of each colored sample was measured to determine its photographic characteristics. The results obtained are shown in Table 3 below.

The following can be seen from the results shown in Table 3 below.

TABLE 3

| Sample | Fog Density Yellow | Fog Density Magenta | Fog Density Cyan | Relative Sensitivity Blue-Sensitive Layer | Relative Sensitivity Green-Sensitive Layer | Relative Sensitivity Red-Sensitive Layer | MT Value (10 cycle/mm) |
|---|---|---|---|---|---|---|---|
| A | 0.13 | 0.13 | 0.13 | 98 | 102 | 102 | 0.72 |
| B | 0.13 | 0.13 | 0.13 | 98 | 102 | 102 | 0.69 |
| C | 0.12 | 0.13 | 0.13 | 98 | 102 | 102 | 0.65 |
| D | 0.12 | 0.13 | 0.13 | 100 | 100 | 102 | 0.46 |
| E | 0.12 | 0.13 | 0.13 | 100 | 100 | 102 | 0.55 |
| F | 0.16 | 0.13 | 0.13 | 98 | 102 | 102 | 0.74 |
| G | 0.12 | 0.13 | 0.13 | 100 | 100 | 100 | 0.15 |
| H | 0.12 | 0.13 | 0.13 | 100 | 100 | 102 | 0.50 |

All the samples exhibits good characteristics as color papers. However, the sensitivities of Samples A, B, C, E and F of the present invention are somewhat higher than those of Samples D, G and H (comparative samples). In Sample F in which the second layer is omitted, yellow fogging occurs somewhat noticeably.

The MT value, described in T. H. James ed., *The Theory of the Photographic Proces,* 4th ed., page 526, the unexposed Samples A to G were measured of and the sharpness compared. The results obtained are shown in Table 3 above. The closer the MT value is to 1.0, the better is the sharpness; in printing an image, the image is less discolored or blurred. All the MT values shown in the present specification are experimental values when the green-sensitive silver halide emulsion layer is measured at a space frequency of 10 cycle/mm. It is to be noted, however, that the effect of the present invention is not limited to the green-sensitive emulsion layer or this space frequency.

The MT values of Samples A, B, C, E and F are greater than those of Samples D, G and H (comparative samples) and thus it can be seen that Samples A, B, C, E and F have greatly improved sharpness. This effect is remarkable particularly in Samples A, B, C and F in which the amount of titanium oxide pigment coated is not less than 4.0 g/m² and the titanium oxide pigment content is not less than about 68% by weight.

EXAMPLE 2

The same support as described in Example 1 was used except that the polyethylene layer on one side of the support contained 7.5% by weight of rutile type titanium white pigment having a mean grain size of 0.23μ. The same hydrophilic colloid layer and silver halide emulsion layer as described in the preparation of Sample B of Example 1 was coated on the support to prepare a light-sensitive material (Sample J).

The MT values of Samples B, G and J were measured in the same manner as described in Example 1. The results obtained are shown in Table 4 below.

TABLE 4

| Sample | MT Value (10 cycle/mm) |
|---|---|
| B | 0.69 |
| G | 0.15 |
| J | 0.74 |

It can be seen that Samples B and J of the present invention have large CTF at any line width and have satisfactory sharpness, and that, in particular, the sharpness of Sample J is superior.

While the invention has been described in detail and with reference to specific embodiments thereof, it will be apparent to the skilled in the art that various changes and modifications can be made therein without departing from the spirit and scope thereof.

What is claimed is:

1. A color photographic element comprising:

(1) a support comprising a paper substrate with a polyolefin film provided on both sides thereof;

(2) a hydrophilic colloid layer containing titanium dioxide as a white pigment on one side of the support (1); and (3) a light-sensitive silver halide emulsion layer on the hydrophilic colloid layer (2), wherein the titanium dioxide content of the hydrophilic colloid layer (2) is at least about 68% by weight.

2. The element as claimed in claim 1 wherein the content of the titanium dioxide is from 68 to 93% by weight.

3. The element as claimed in claim 1, wherein the content of the titanium oxide is from 76 to 88% by weight.

4. The element as claimed in claim 1, wherein the amount of titanium oxide coated is about 4 $g/m^2$ or more.

5. The element as claimed in claim 1, wherein the polyolefin is polyethylene.

6. The element as claimed in claim 1, further including a gelatin intermediate layer interposed between the hydrophilic colloid layer and the silver halide emulsion layer.

7. The element as claimed in claim 6, wherein the thickness of the intermediate layer is from about 0.2 to 2 $\mu m$.

8. The element as claimed in claim 6, wherein the intermediate layer contains a dye or antifoggant.

9. The element as claimed in claim 1, wherein the titanium dioxide is coated on the support in an amount of at least 2 $g/m^2$.

10. The element as claimed in claim 1, wherein the titanium dioxide is coated on the support in an amount of at least 4 $g/m^2$.

11. The element as claimed in claim 1, wherein the thickness of the hydrophilic colloid layer containing the titanium dioxide is from about 1 to about $10\mu$.

12. The element as claimed in claim 1, wherein the thickness of the hydrophilic colloid layer containing the titanium dioxide is from 2 to $5\mu$.

* * * * *